United States Patent [19]

Nichols

[11] Patent Number: 4,541,344

[45] Date of Patent: Sep. 17, 1985

[54] CANTILEVER SHELVING RACK

[75] Inventor: Max Nichols, Montgomery, Ill.

[73] Assignee: Aurora Equipment Company, Aurora, Ill.

[21] Appl. No.: 422,882

[22] Filed: Sep. 27, 1982

[51] Int. Cl.[4] ..... A47F 5/10

[52] U.S. Cl. ..... 108/108; 248/243; 211/182; 211/190; 211/193

[58] Field of Search ..... 108/108, 109, 106; 248/243, 235, 201, 251; 211/182, 190, 191, 192, 193, 189, 177, 176

[56] References Cited

U.S. PATENT DOCUMENTS

| | | | |
|---|---|---|---|
| Re. 25,912 | 11/1965 | Kaufman et al. | 211/191 |
| 3,041,807 | 7/1962 | Getzin et al. | 248/243 X |
| 3,158,265 | 11/1964 | Thimons | 211/190 |
| 3,606,024 | 9/1971 | Mieville | 211/193 |
| 3,787,016 | 1/1974 | Laval, Jr. | 211/193 X |
| 3,827,377 | 8/1974 | Aughtry, Jr. | 108/108 |
| 3,896,718 | 7/1975 | Giambalvo | 108/108 |
| 4,148,263 | 4/1979 | Suttles | 108/111 X |

*Primary Examiner*—William E. Lyddane

*Assistant Examiner*—Peter A. Aschenbrenner

*Attorney, Agent, or Firm*—Hill, Van Santen, Steadman & Simpson

[57] ABSTRACT

A storage rack comprising a series of columns for supporting shelves with each column having slots at vertically spaced intervals corresponding to locations for supporting shelves, the slots on one column being horizontally aligned with the slots on the column adjacent thereto, shelf supports each supported by at least the slots on the associated column with each of the supports extending horizontally across the columns both forwardly and rearwardly of the columns thereby supporting shelves on opposite sides of the columns, fastener means fixedly locking the shelf supports in a fixed position relative to the columns, shelves mounted at opposite ends of the shelf supports on opposite sides of the columns with the columns being positioned centrally of the shelves as opposed to an outside location insuring maximum available shelf space with unimpaired access to the shelves, and shelf fastener means securing the shelves in fixed unitary assembly relative to the shelf supports.

13 Claims, 13 Drawing Figures

FIG. 9
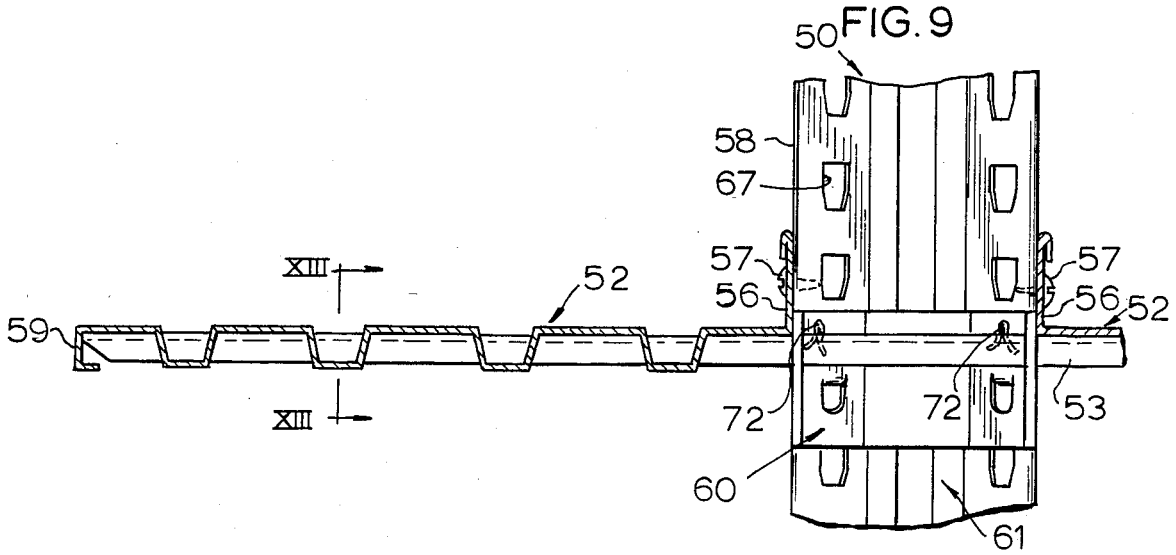
FIG. 10
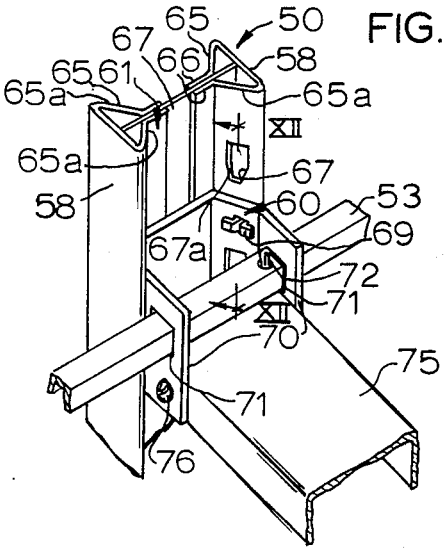
FIG. 11
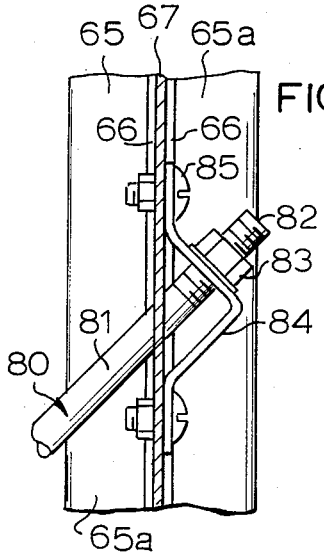
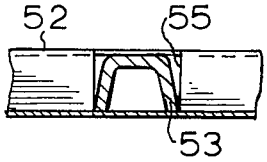
FIG. 13
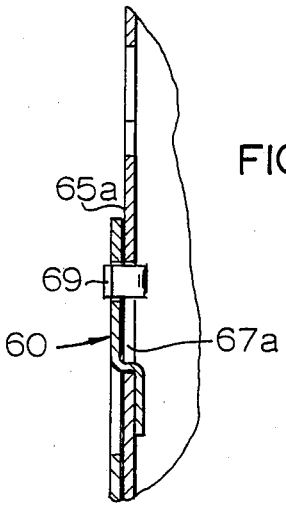
FIG. 12

CANTILEVER SHELVING RACK

The present invention relates generally to a storage shelving rack which can be shipped in a knockdown form and then assembled at the point where it is to be installed.

The shoe-rack herein disclosed can be particularly used for the storage of shoes or other articles. It has been found that shoe stores commonly store their shoes only one or at the most two boxes high on each shelf. The reason that this procedure is commonly followed is to enable the shoe clerk to readily remove the shoe boxes and to return them to the stacks. It has been found that where different storage procedures are followed, the clerk will commonly pull out the bottom box of several stacks to try on the shoes for a customer and the shoe boxes seldom are placed back onto the shelving in the same order since the shoe clerks work on commission and are not paid for moving a stack of boxes back and forth with respect to the shoe rack.

For a long time this was no problem. Masonite or thin plywood was cheap and shoes are light and there was plenty room in the back of the store.

The shoe stores began to be located in shopping centers where space is very dear. Store operators then built their wood shelving clear to the ceiling with narrow aisles, as steel cost too much and the flanges of the shelves took up too much vertical space.

Now the insurance people have discovered that shoes on wood shelves make a very hot fire and one requiring the wood to be treated with anti-fire chemicals which substantially raised the price of materials. According to important objects of the present invention, a new and improved knockdown storage shelving rack preferably of an all metal fire resistant construction is here provided.

According to still other features of the present invention, a new and improved shelving structure has been provided which has a minimum number of posts and where each shelf is of a ribbed construction to maximize its strength.

Still another object of this invention is to provide a new and improved storage shelving rack wherein there are no front or rear posts so that boxes can be stored on the shelving continuously for the length of aisles on each side of the shelving structure.

Yet another object of this invention is to provide a new and improved cantilever-type storage shelving rack where the supporting posts are centrally positioned and where shelf supports extend forwardly and rearwardly of the posts and supported thereby with the ribbed shelves mounted at opposite ends on the shelf supports.

According to other features of my invention, I have provided a storage rack comprising a series of columns for supporting shelves with each column having slot means at vertically spaced intervals corresponding to locations for supporting shelves, the slot means on one column being horizontally aligned with the slot means on the column adjacent thereto, shelf supports each supported by the slot means on the columns with each of the supports extending horizontally across the columns both forwardly and rearwardly of the columns thereby supporting shelves on opposite sides of the columns, fastener means fixedly locking the shelf supports in a fixed position relative to the columns, shelves mounted at opposite ends on the shelf supports on opposite sides of the columns with the columns being positioned centrally of the shelves as opposed to an outside location insuring maximum available shelf space with unimpaired access to the shelves, and shelf fastener means securing the shelves in fixed unitary assembly to the shelf supports.

According to still further features of my invention, I have provided a column with parallel sides and with the slots being generally T-shaped on opposing sides thereof, the slots being inverted with the stem of the T pointing upwardly, and the shelf supports being T-shaped and extended through the slots in the opposite sides of the associated column.

Yet other features of my invention contemplate the use of a column having angularly disposed upright sides on each side of the associated column diverging in a direction away from the column, and a support bracket having diverging upright bracket sides for snug engagement with the column sides, the brackets further having parallel terminal bracket legs carrying said slot means, and with the load of the associated shelf being carried through the shelf supports and the bracket to the associated column.

DESCRIPTION OF THE DRAWINGS

FIG. 9 is an enlarged fragmentary partially sectioned view illustrating the manner of assembly of the shelf support on a column;

FIG. 10 is a perspective view further illustrating the way in which the shelf supports are mounted on the column;

FIG. 11 is a vertical section illustrating a further detail involving rack bracing mounts;

FIG. 12 is a sectional view taken generally on the line XII—XII of FIG. 10 looking in the direction indicated by the arrows; and FIG. 13 is an enlarged fragmentary partially sectioned view showing the ribbed shelf mounted on a shelf support channel.

Figure 1:
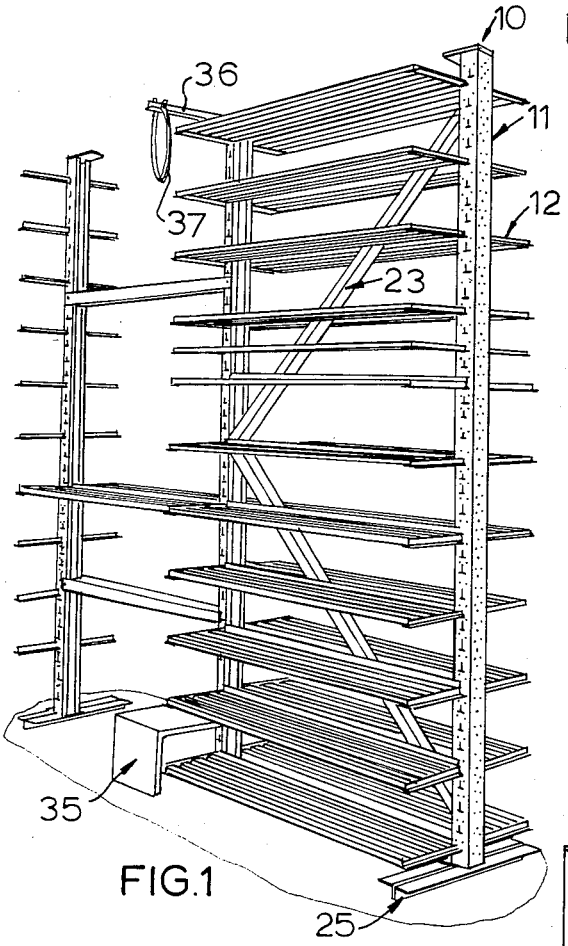
FIG. 1 is an enlarged fragmentary perspective view of a storage rack embodying important features of my invention.
Figure 2:
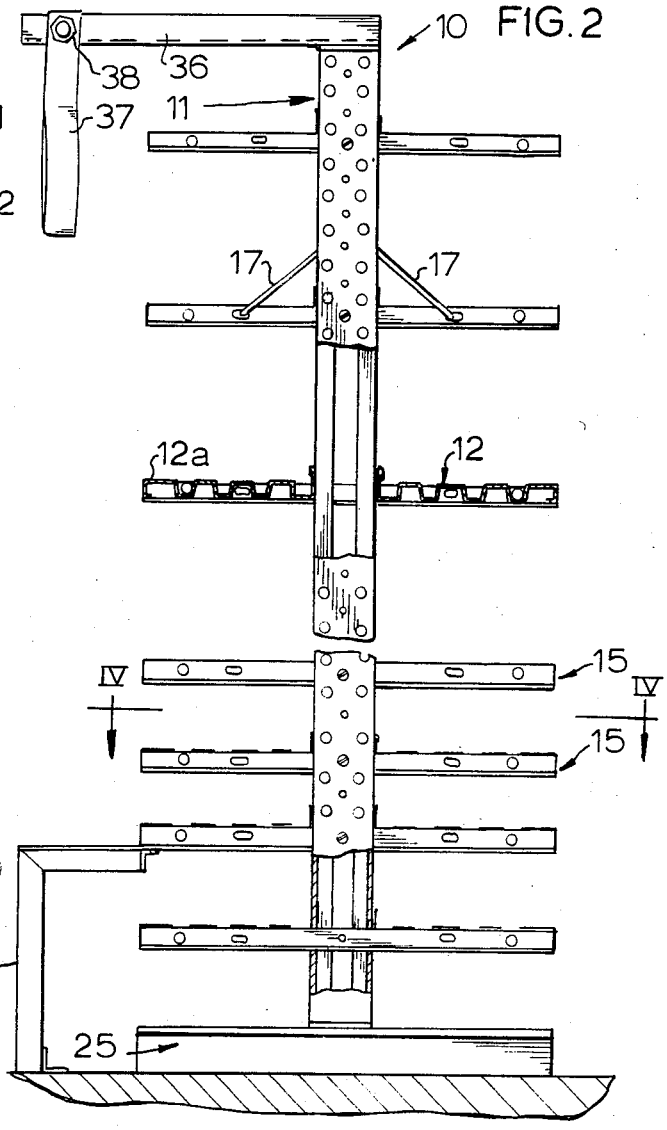
FIG. 2 is an enlarged fragmentary end view of the storage rack shown in FIG. 1.

The reference numeral 10 indicates generally a storage rack which embodies important features of my invention. The rack 10 includes a series of spaced columns 11 for supporting shelves 12 on opposite sides.

Figure 3:
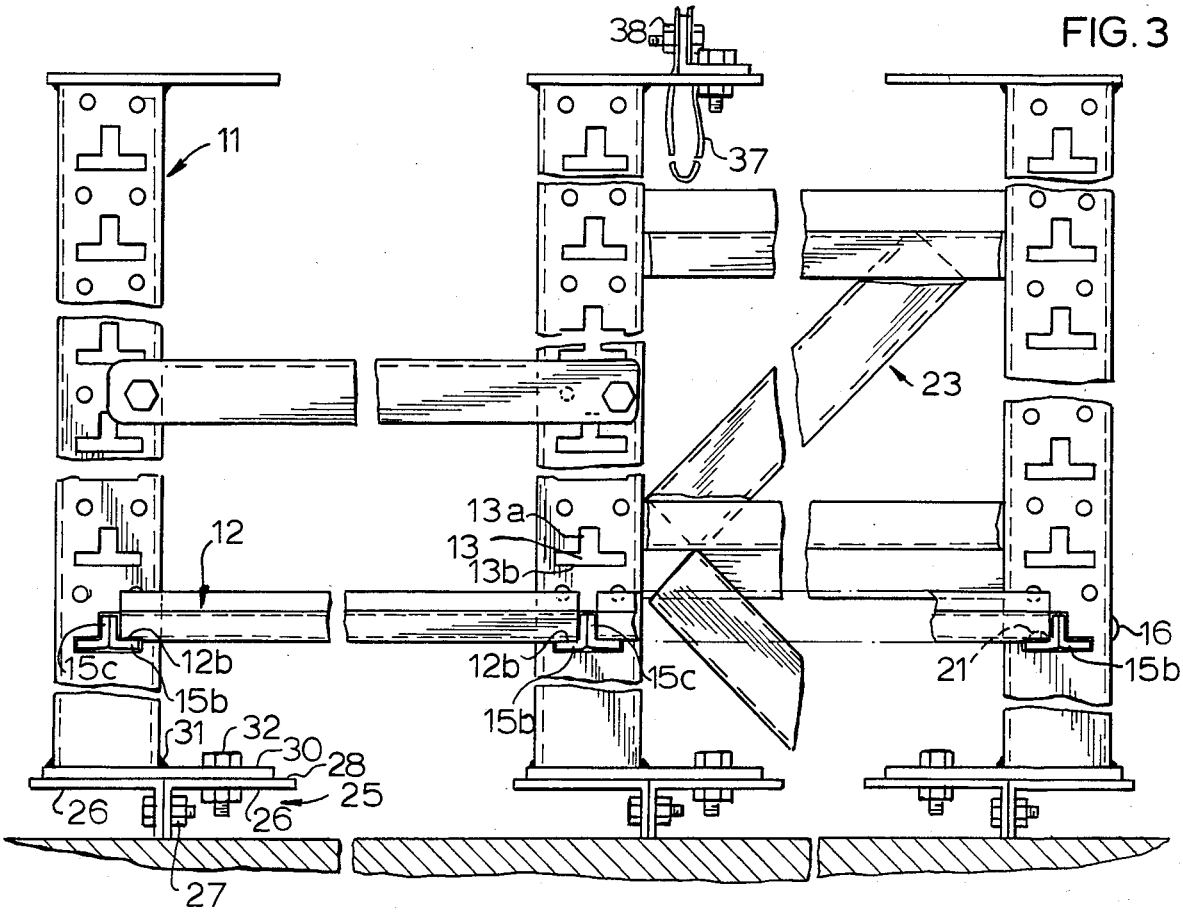
FIG. 3 is an enlarged fragmentary front view of the storage rack shown in FIG. 1.
Figure 4:
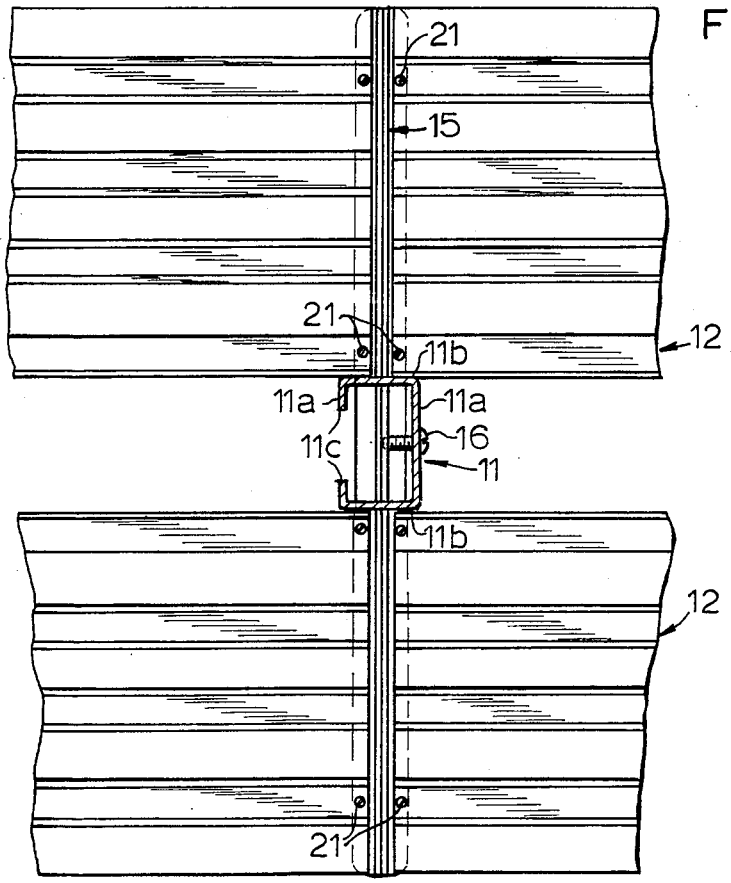
FIG. 4 is a horizontal section taken on the line IV—IV looking in the direction indicated by the arrows as seen in FIG. 2.

In the preferred form of my invention, as illustrated in FIGS. 1–5, each of the columns 11 is generally of a C-shaped configuration with opposite parallel sides being indicated at 11*a*—11*a* and 11*b*—11*b* (FIG. 4). Opposite ends of the C-shaped column are indicated at 11*c*—11*c* and these ends are disposed in spaced confronting relation as is illustrated in FIG. 4.

Punched on two sides 11*b*—11*b* of each column are vertically spaced inverted T-shaped slots 13 with each of the T-shaped slots having a stem slot portion 13*a* overlying a cross-piece slot portion 13*b* (FIG. 3).

Cooperable with the slots 13 on the columns 11 are a series of T-shaped shelf supports 15. The T-shaped shelf supports are so fabricated as to be slidable through the T-shaped slots 13 in the columns and supported on opposite sides 11*b*—11*b* of the column 11 as is illustrated in FIG. 4. A fastener 16 in the form of a self-tapping screw 16 is provided for holding the shelf support 15 in a properly adjusted position with respect to the column 11 so the shelf support can extend on opposite sides of the column 11 at a predetermined distance therefrom.

Figure 5:
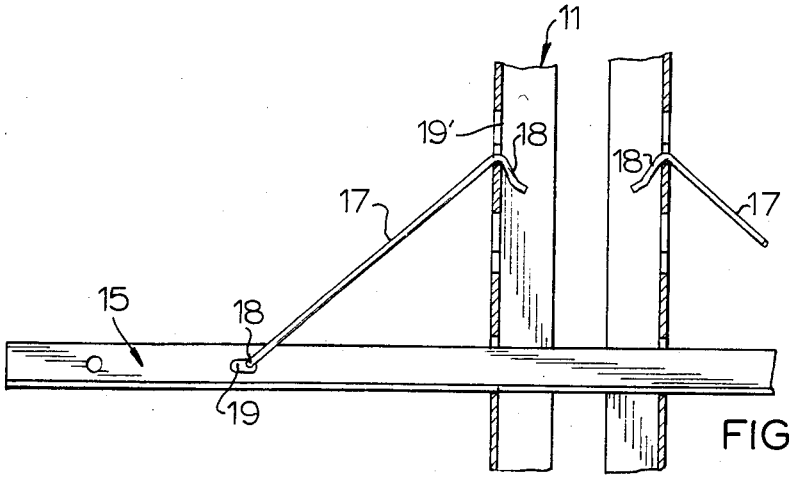
FIG. 5 is an enlarged fragmentary detailed view illustrating hanger wires supporting the shelf support bracket on the associated column.

In order to assist in suspending the shelf supports 15 from the column 11, wire hanger straps 17—17 can be provided. These straps 17 have hooked ends at opposite ends thereof as indicated at 18—18 which wire straps are cooperable with strap slots 19—19′ as provided in the shelf support 15 and in the column 11 (FIG. 5).

Mountable upon the shelf supports 15 are the shelves 12 which are each of a ribbed construction. The shelves preferably are of a metallic construction of a type that can be formed in a press as a stamping. The ribs serve to rigidify the shelves and are indicated at 12*a*. When the shelves are mounted on the shelf support 15 at opposite ends 12*b*—12*b* (FIG. 3) the ends 12*b*—12*b* rest on cross-piece shelf support portions 15*b*—15*b*. Sidewise movement of the shelves 12 is prohibited since each of the shelf supports 15 has an upright stem shelf support portion 15*c*. Thus, when the shelves 12 are mounted on the shelf supports 15, the opposite ends 12*b*—12*b* are engageable against the upright stem shelf support portions 15*c*—15*c*. In order to anchor the shelves 12 on the shelf supports 15, self-tapping screws 21 are extended through the rib-shaped shelf and connected with the shelf support cross-piece portion 15*b*, as illustrated in FIG. 3. Any suitable number of fasteners can be provided to insure proper connection between the shelf and its shelf supports associated therewith.

It will, thus, be seen that when the shelves 12 are on the shelf supports 15 that a pair of shelves are required at each level so that each side of the rack 10 can be provided with shelving. Each of the shelf supports functions to support a pair of shelves since the shelf support extends through the column 11 and coacts with the shelves positioned on the opposite sides of the column. A gap is left between the back to back shelves 12 where rack bracing structure 23 is provided to rigidity the rack 10.

Suitable rack stands can be provided as indicated at 25 for mounting the rack 10 in a supported position on a floor. If desired, the rack 10 can be directly anchored to the floor by suitable mounting bolts. As illustrated, the rack stand 25 is generally T-shaped and is comprised of a pair of angles 26—26 which are secured by suitable fasteners 27 in assembly together. The stand 25 thus provides a flat top side surface 28 and each column 11 is mountable thereon. The column 11 includes a foot plate 30 that is welded at 31 in assembly with the column 11. Suitable fasteners 32 are provided for anchoring the foot plate 30 to the stand 25, as indicated in FIG. 3.

For the purpose of assisting the user of the rack 10 in stacking boxes or other goods on upper shelves of the rack, a foot stand 35 is provided. The foot stand can be attached directly to the column in adjacency thereto or to the shelf support 15 by suitable fasteners, as may be desired. At the top of the rack, a strap arm 36 is suitably attached to the top of anyone of the columns 11. Suitable fasteners or a weld may be employed to make the connection between the strap arm 36 and the column. At an opposite end of the strap arm 36, a strap 37 is secured thereto by suitable bolt and nut fasteners 38. Thus, when a person desires to step up onto the foot stand 35, he can grab the strap 37 and support himself in stepping up onto the stand and can further use the strap 37 to steady himself while he is stacking or unstacking the shelves 12.

Shown in FIGS. 6–13 is a modified storage rack 50 which also embodies important features of my invention. The column is indicated at 51 and the shelves at 52. Shelf support channels 53 are mounted on the columns 50 for supporting the shelves 52. In this instance, the shelves 52 are of a ribbed construction and have transverse passage ways 55 (FIG. 13) for receiving the shelf support or shelf support channels 53. Thus, it will be seen that the shelves 52 are in telescoped assembly with the shelf supports 53. In order to anchor the shelves 52 in assembly with the columns, the shelves are provided with an upstanding flange 56 (FIG. 9) and this flange is secured by self-tapping screws 57 to one of a pair of parallel column sides 58—58. An opposite end of the shelf 52 is turned under to provide a protective shelf flange 59 which hangs over outer ends of the shelf supports 53 to conceal them from view and to make the rack more attractive in its overall appearance.

According to other features of my invention I have provided a novel support bracket 60 for the purpose of providing a device for securing the shelf supports or channels 53 to the columns 50. To this end, the bracket 60 has a configuration which matches a face 61 of the column 50 so that the bracket can be nestingly engaged with the column 50 in nested supported assembly therewith.

In this form of my invention, the columns 50 are of a modified construction and are each formed of folded sheet material which includes a pair of column caps 65—65 which have spaced cap legs 66—66. A connecting column plate 67 extends between the legs 66—66 of each cap 58—58 and is secured in welded assembly therewith. The welds can extend through the legs 66 into the plate 67 to form the welded connections.

Each of the column caps 65 include diverging column legs 65*a*—65*a* and it is against these surfaces that the bracket 60 abuts. The column legs 65*a*—65*a* are provided with key hole slots 67 and resilient dart clips 69 are provided for securing the bracket 60 to the column legs 65*a*—65*a* and more particularly the clips 69 coact with the slots 67—67 to attain this end. The dart clips 69 are preferably manufactured from resilient spring steel so that when the legs of the clips are pressed together the clip can be readily inserted into the key hole slot and moved into the narrowed lower end 67 of the slot to effect a solid connection between the clip and the edges of the slot to firmly hold the bracket onto the column 51.

The bracket 60 has a pair of parallel legs 70—70 which are each provided with bracket slots 71—71 and these slots are in horizontally aligned relation with respect to one another as is seen in FIG. 10. When the components of the bracket assembly are in assembled relation, the shelf supports or channels 53 project through the bracket slots 71—71 and are secured in adjusted relation by means of a pair of cotter pins 72—72. These cotter pin7s extend into the shelf support between the bracket legs 70—70 and in effect enlarge the size of shelf support so that the shelf support cannot move through the bracket slots 71—71.

In order to rigidify the rack 50, a spreader channel 75 extends between adjacent columns 51—51 and are secured at opposite ends to the bracket 60 by means of self-tapping metal screws 76. These screws project through the bracket legs 70—70 into the channel 75 as is seen in FIG. 10. If desired, bolt and lock nut assemblies can be used instead of the self-tapping screws 76.

For the purpose of further rigidifying the rack 50, bracing 80 (FIGS. 6 and 11) has been provided. The bracing is in the form of tension rods 81 each of which has opposite ends which are secured to adjacent side-by-side columns 51—51. In order to secure the tension rods or bracing rods to the column, the structure for attaining this end has been shown in FIG. 11. More specifically, the rod 81 has a threaded end and a nut 83 is threaded thereon. The rod 81 extends from one side through the plate 67 and through an opening in bracket 84. The bracket 84 is attached by fasteners 85 to the plate 67. Thus, as the nuts 83 are drawn tight tension is applied to the brackets 84 and to the plate 67 thereby rigidifying the columns.

Figure 6:
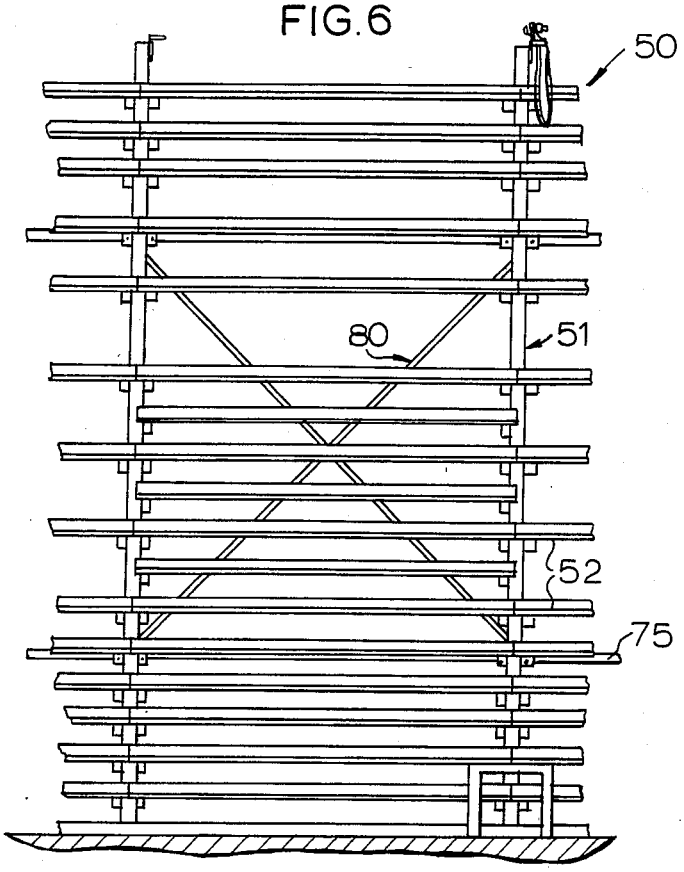
FIG. 6 is an enlarged fragmentary side view of a modified storage rack.
Figure 7:
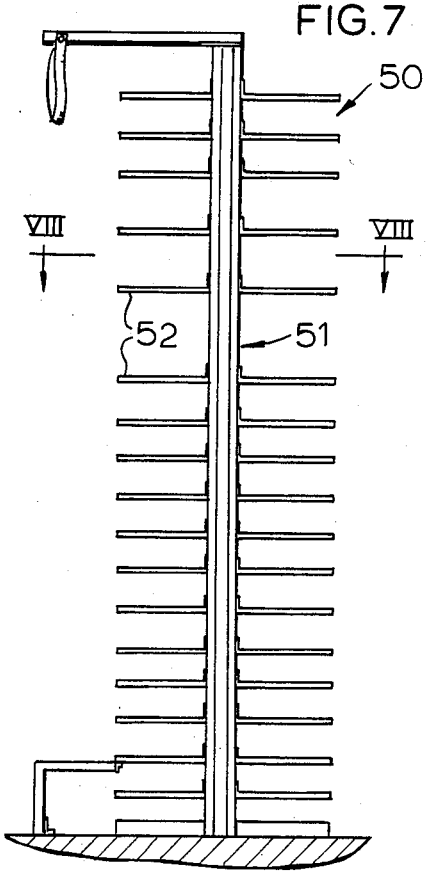
FIG. 7 is a fragmentary end view of the storage rack shown in FIG. 6.
Figure 8:
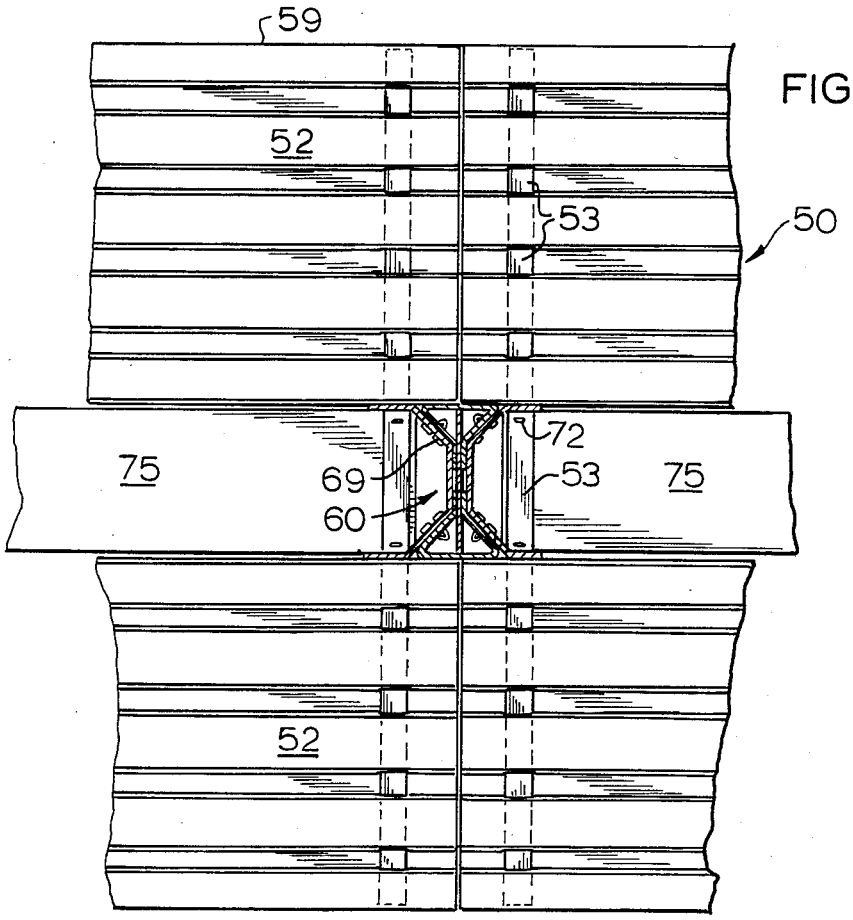
FIG. 8 is a vertical section taken on the line IIX—IIX looking in the direction indicated by the arrows as seen in FIG. 7.

It will thus be seen that the two forms of rack illustrated herein in FIGS. 1 and 6 have common features in that the columns either possess slots in the columns themselves or possess brackets attached to the columns and the brackets carry the slots whereby in both instances, the shelf supports are mounted on the columns and extend through either type of the thusly described slots. Thus, the shelf supports are each supported by the slots on the columns on the racks shown in FIGS. 1 and 6. Further, fastener means are provided to fixedly lock the shelf supports in a fixed position relative to the column. Both types of racks, as shown in FIGS. 1 and 6, have shelves that are mounted at opposite ends on the shelf supports on opposite sides of the columns with the columns being positioned centrally of the shelves as opposed to an outside location insuring maximum available shelf space with unimpaired access to the shelves. Shelf fastener structure is further provided to secure the shelves in fixed unitary assembly relative to the shelf supports.

I claim:

1. In a storage rack, the improvement comprising a series of columns for supporting shelves with each column having slot means at vertically spaced intervals corresponding to locations for supporting shelves, the slot means on one column being horizontally aligned with the slot means on the column adjacent thereto, each column having angularly disposed upright column sides on each side of the associated column diverging in a direction away from the column, and a support bracket having diverging upright bracket sides for snug engagement with the column sides, the brackets further having parallel terminal bracket legs carrying said slot means, and with the load of the associated shelf being carried through the shelf supports and the bracket to the associated column, shelf supports each supported by said slot means on said columns with each of the supports extending horizontally across the columns both forwardly and rearwardly of said columns thereby supporting shelves on opposite sides of the columns, fastener means fixedly locking said shelf supports in a fixed position relative to said columns, shelves mounted at opposite ends on said shelf supports on opposite sides of said columns with the columns being positioned centrally of the shelves as opposed to an outside location insuring maximum available shelf space with unimpaired access to the shelves, and shelf fastener means securing said shelves in fixed unitary assembly relative to said shelf supports.

2. The rack of claim 1 further characterized by each column having parallel sides and with the slots being generally T-shaped in opposing sides thereof, the slots being inverted with the stem of the T pointing upwardly, and the shelf supports being T-shaped and extended through the slots on the opposite sides of the associated column.

3. The rack of claim 1 further characterized by said fastener means locking said shelf supports in assembly with said columns comprising self-tapping screws bearing between a side of the column and the shelf support prohibiting relative movement of the shelf support with respect to the column.

4. The rack of claim 1 further characterized by the shelf fastening means comprising screws extended through said shelves into said shelf support locking these components in locked assembly together.

5. The rack of claim 1 further characterized by each of said shelves being of a ribbed construction and with the ribs extending in a direction generally at right angles to said shelf supports.

6. The rack of claim 1 further characterized by said fastener means comprising a series of resilient clips operable to secure the spaced legs and the upright sides in snug assembly together.

7. The rack of claim 1 further characterized by said fastener means, comprising a series of resilient clips operable to secure the spaced legs and the upright sides in snug assembly together.

8. The rack of claim 1 further characterized by each shelf being comprised of a single piece of metal of uniform thickness and with the shelf having longitudinally extending transversely spaced ribs extended along the length thereof, sets of aligned openings adjacent opposite ends of the shelf with the openings extending through the ribs, the support brackets being engaged in the sets of rib openings thereby mounting the shelving on said columns, and means positively affixing said shelving to said columns when the shelving is mounted on said support brackets.

9. In a storage rack, the improvement comprising a series of spaced upright columns each having a pair of angularly disposed upright sides with sets of confronting key hole slots arranged in vertically spaced relation on said columns, support brackets each having parallel spaced legs extending away from said columns, fastener means securing each bracket with a pair of the key hole slots on the associated pair of the angularly disposed upright sides, a pair of channel support holes provided in said legs of each of said support brackets, shelf support channels mounted in said channel support holes on said legs of each of the brackets and with the support channels extending forwardly and rearwardly of said column for supporting shelves on opposite sides of said columns, channel fastener means locking said shelf support channel in upright assembly with said support bracket, spreader channels mounted between the legs of a confronting pair of said channel brackets for securing adjacent columns in rigid assembly together, and spreader channel attachment means for securing the opposite ends of each spreader channel in retained assembly with the associated support bracket thereby securing the columns in unitary assembly together.

10. The rack of claim 9 further characterized by the channel fastener means comprising a pair of cotter pins extending through said shelf support channel anchoring the channel with the legs on said support bracket.

11. The rack of claim 9 further characterized by the spreader channel attachment means comprising bolt and lock nut assemblies anchoring each of the legs on the associated support brackets to said spreader channel.

12. The rack of claim 9 further characterized by said fastener means securing each bracket with a pair of the key hole slots comprising hook-shaped fingers struck-out from the material of the support bracket, each finger having one end integral and secured with the support bracket and an opposite free end for securement in an associated key hole slot.

13. The rack of claim 9 further characterized by the ribs on said shelves having rib openings and with said support brackets being engaged in the rib openings thereby mounting the shelving on said columns, and means positively affixing said shelving to said columns when the shelving is mounted on said support brackets.

* * * * *